US005201076A

United States Patent [19]

Schemine, Jr.

[11] Patent Number: 5,201,076

[45] Date of Patent: Apr. 13, 1993

[54] TIE TIP

[76] Inventor: Edward J. Schemine, Jr., 4551 Haverfield Ct., Hilliard, Ohio 43026

[21] Appl. No.: 624,543

[22] Filed: Dec. 10, 1990

[51] Int. Cl.[5] ..... A41D 25/16

[52] U.S. Cl. ..... 2/145; 2/152 R

[58] Field of Search ..... 2/132, 134, 137, 141 A, 2/145, 156, 152 R, 152 A; 24/49 A, 49 C, 67 CF, 900

[56] References Cited

U.S. PATENT DOCUMENTS

| | | | |
|---|---|---|---|
| 524,647 | 8/1894 | Pancoast | 24/67 CF |
| 2,543,144 | 2/1951 | Wold | 24/67 CF |
| 2,557,635 | 6/1951 | Cregar | 2/145 X |
| 2,747,192 | 5/1956 | Katz | 2/46 |
| 2,853,043 | 9/1958 | Bitterman et al. | 24/67 CF |
| 4,558,469 | 12/1985 | Richter | 2/46 X |
| 4,922,553 | 5/1990 | Morrone | 2/134 X |

*Primary Examiner*—Werner H. Schroeder
*Assistant Examiner*—Jeanette E. Chapman

[57] ABSTRACT

A v-shaped wedge design fashion trim article designed to conform and attach to the apex of necktie through a crimping process, thereby not damaging the attached necktie material as occurs with other such necktie trim articles and attachment processes; compromising a v-shaped wedge design enclosure formed of a front plate with bent-up and over side sections and a back plate spaced from the front plate for receiving therebetween the apex of a necktie.

1 Claim, 4 Drawing Sheets

TIE TIP

BACKGROUND

1. Field of Invention

This invention relates to a fashion necktie trim apparel article, specifically a v-shaped wedge design trim article designed to conform and attach to the apex of a necktie; which does not require a supplemental attachment process; which will not damage the necktie material; and which can be manufactured at a relatively inexpensive cost.

Supplemental attachment processes consist of pins, clamps, levers, flaps, prongs, tongues, etc. Damage to the necktie material can occur through the supplemental attachment process or through such means as folding, bending, penetrating, etc. Damage through the supplemental attachment occurs by the mere nature of edges, points, etc. used in the attachment process. Damage through folding, bending, penetrating, etc., occurs by unsightly creases, fraying, and wearing which remain present, even after such trim article is removed. The present invention does not require a supplemental attachment process and will not damage the necktie material.

Such trim articles are also manufactured in a relatively time consuming and expensive process. Time and cost factors are not only reflected in the manufacture and assembly of supplemental attachment parts and pieces, per se, but are additional to the actual trim article itself.

Many variations of such trim articles have been made and improved upon, including paper fasteners, page markers, etc. Variations of such trim articles typically describe an improved supplemental attachment process. Because of the durable material from which such trim articles are manufactured, the obvious improvement is to the supplemental attachment process, not to the trim article itself as an attachment process.

Unique in design and application to such necktie trim apparel articles is a v-shaped hollow wedge design trim article, the interior surfaces of the wedge being smooth and designed to conform and attach to the apex of a necktie through the process of crimping. Attachment occurring through crimping will not damage the necktie material as other attachment processes do.

The crimping process and the enabling disclosure can be further defined in the following manner. In a crimping process, the apex of the necktie is inserted into the tie tip opening, which is located between the front and back sections of the trim article. The front and back sections of the trim article are pinched together, with the apex of the necktie inserted between. The force applied against the apex of the necktie, as the front and back sections of the trim article are drawn together, securely fastens the trim article to the apex of the necktie tie.

In the present invention, the trim article itself is used for the attachment, thus requiring no supplemental attachment process. Damage does not occur to the necktie material as it does with other such trim articles and attachment processes. In addition, prior art does not reveal any such v-shaped wedge design necktie trim articles designed to conform and attach to the apex of a necktie through a crimping process.

The unobviousness of such an invention is further stated by example of unsuggested modifications and a lack of implementation. Prior art lacks any suggestions that such necktie trim apparel article references should be modified and used for the purpose and in a manner mentioned hereto. In addition, if the present invention were in fact obvious, because of the design, application, and advantages; those skilled in the art surely would have implemented such an invention by now.

It is, therefore, the objective of the present invention to provide a v-shaped wedge design necktie trim apparel article, which is designed to conform to the apex of a necktie, which is secured and attached by a crimping process, which does not require a supplemental attachment process, and which will not damage the necktie material.

2. Description of Prior Art

Prior art does not reveal any such v-shaped wedge design necktie trim apparel articles designed to conform and attach to the apex of a necktie through a crimping process. Several patents have been issued covering similar trim articles. Examples are pins, clasps, tacks, knots, sleeves, protectors, fasteners, buttons, holders, supports, page markers, paper fasteners, etc.

The following descriptions will illustrate how closely related trim articles differ from the present invention. Furthermore, none describe a v-shaped wedge design necktie trim apparel article designed to conform and attach to the apex of a necktie through a crimping process. In addition, all prior art attachment processes damage the necktie material in one way or another.

U.S. Pat. No. 4,558,469 to Richter, Dec. 17, 1985, describes a fashion trim article which requires a supplemental attachment process. The fashion trim article is designed to be attached through a supplemental attachment process of flaps, pivot pins, bearing walls, tabs, prongs, edges, etc. The prongs or edges used in such an attachment process can easily cause damage to the necktie material.

U.S. Pat. No. 524,647 to Pancoast, Aug. 14, 1894, describes a paper fastener which requires an attachment process of folding and bending. The necessary folding and bending creases the attached material, which is potentially damaging, especially to necktie material.

U.S. Pat. No. 2,853,043 to Bitterman Et Al, Sep. 23, 1956, describes a page corner marker for books which requires a supplemental attachment process. The trim article is designed to be attached through a supplemental attachment process of a tongue and slit. In addition, FIG. 8 of the patent drawings, shows that it is necessary to pierce the attached material with the tongue to complete the attachment process. Such an attachment process is highly undesirable and damaging to necktie material.

U.S. Pat. No. 2,543,144 to Wold, Mar. 23, 1946, describes a paper fastener which requires an attachment process of penetration with pointed tongues. The attachment process will incur two (2) elongated slits into the attached material, caused by the pointed tongues. Such an attachment process will undoubtfully damage the necktie material.

OBJECTS AND ADVANTAGES

Accordingly, besides a v-shaped wedge design necktie trim apparel article which is designed to conform and attach to the apex of a necktie through a crimping process, several objects and advantages of my invention are:

(a) to provide protection to the apex of a necktie (that area covered by the Tie Tip) against stains (foods, liquids, etc.);

(b) to provide protection against fraying and wearing of the apex of a necktie;

(c) to provide a durable and lightweight attachment to the apex of a necktie which will allow a necktie to hang straight and eliminate wrinkles;

(d) to provide an attachment to the apex of a necktie that can be produced in a variety of sizes, designs, materials, and colors;

(e) to provide an attachment to the apex of a necktie that can either be permanently attached or be removable.

Still further objects and advantages of my invention will become apparent from a consideration of the ensuing description and drawings.

DRAWING FIGURES

In the drawing, closely related figures have the same number but different alphabetic suffixes.

REFERENCE NUMERALS IN DRAWING

10: Tie Tip opening
12: front side of the Tie Tip
14: back top sides
16: sides
18: back side of the Tie Tip
20: top of the Tie Tip
22: bottom of the Tie Tip
24: apex of a necktie

Description—FIGS. 1 to 4

Figure 1:
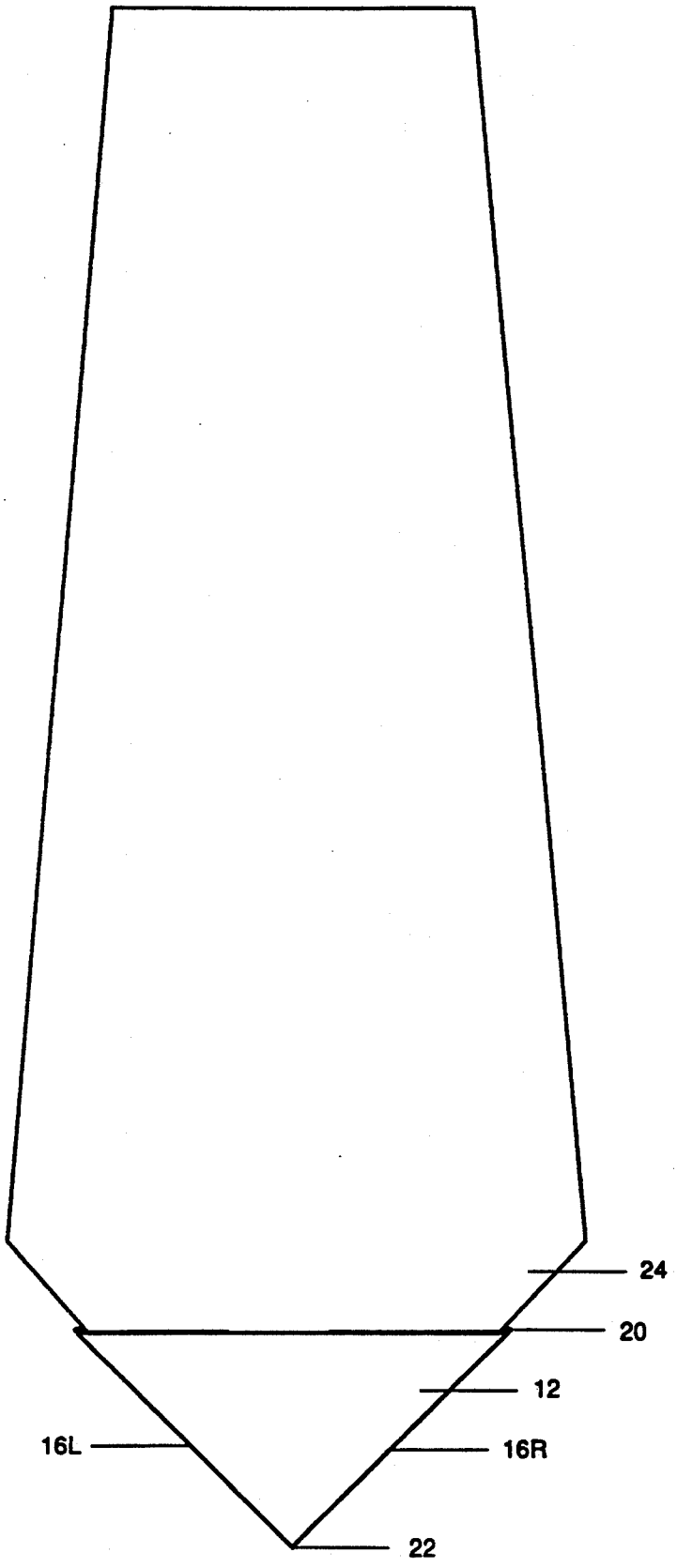
FIG. 1 shows a front perspective view.
Figure 2:
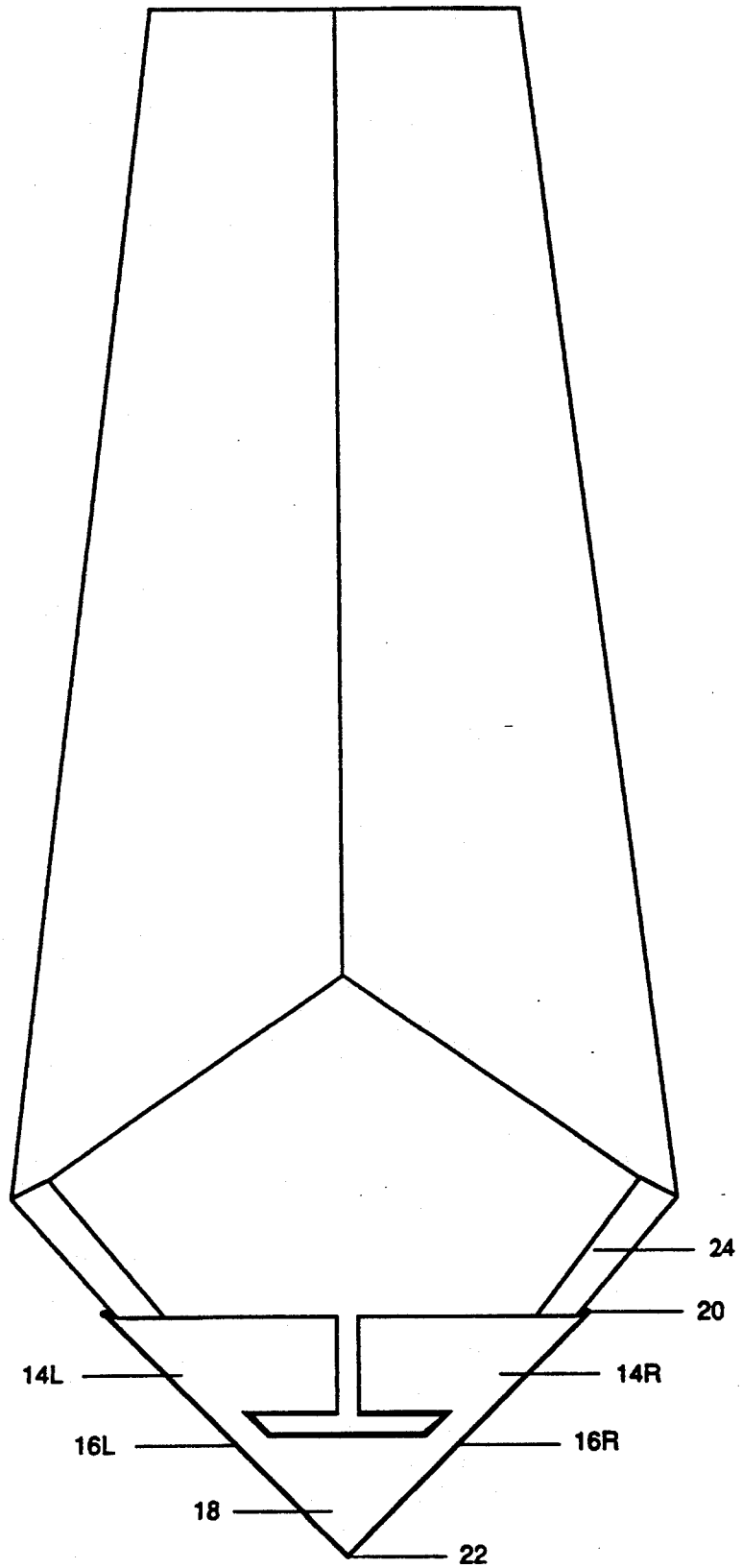
FIG. 2 shows a rear perspective view.
Figure 3:
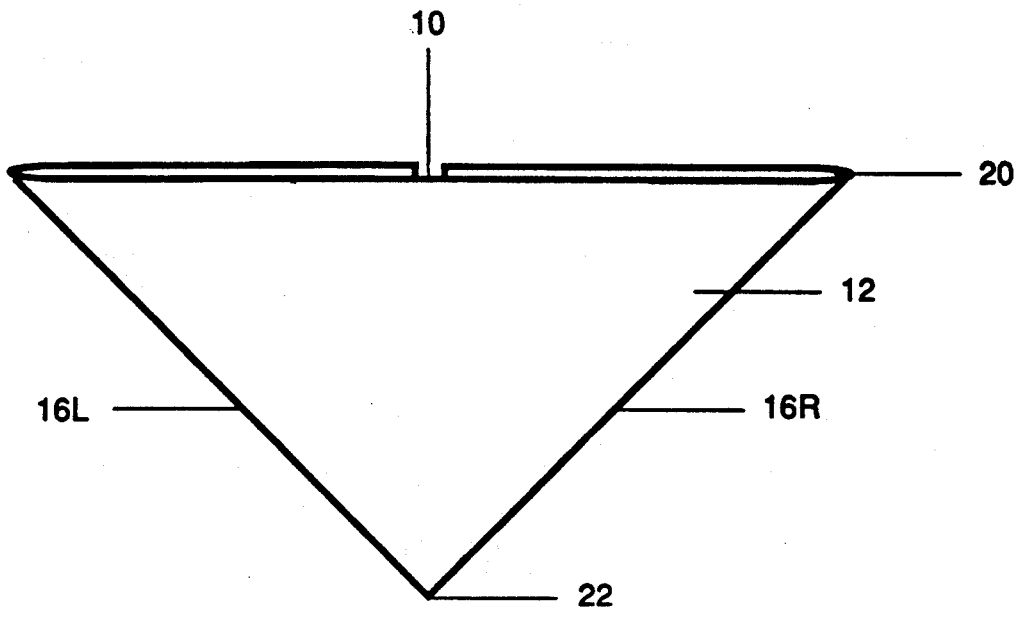
FIG. 3 shows a detailed front view.
Figure 4:
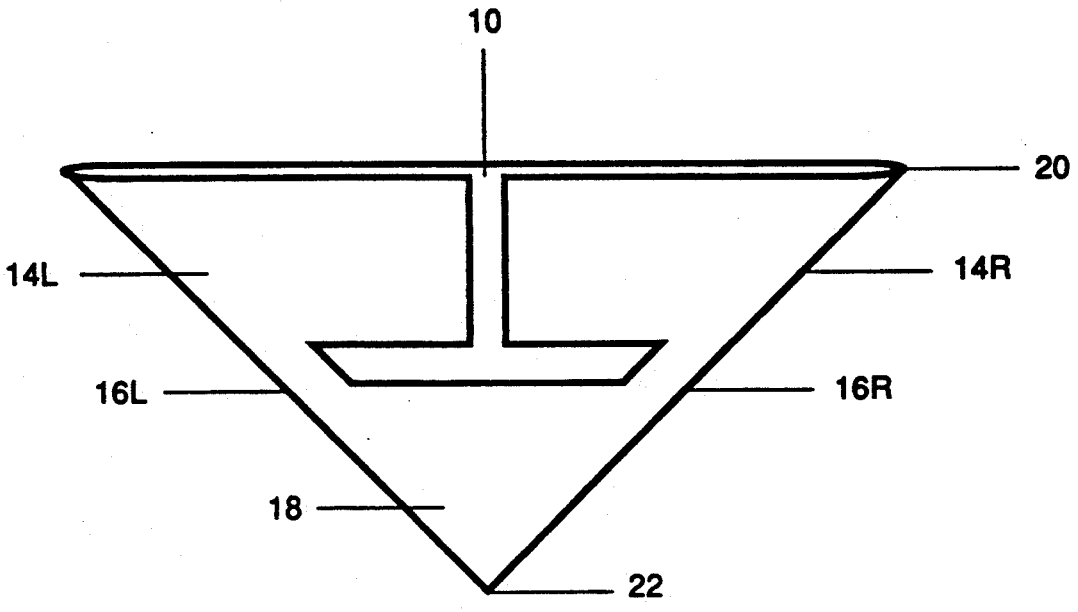
FIG. 4 shows a detailed rear view.

A typical embodiment of the Tie Tip is illustrated in the FIG. 1 (front perspective view), FIG. 2 (rear perspective view), FIG. 3 (detailed front view), and FIG. 4 (detailed rear view). The Tie Tip as illustrated in FIGS. 1 to 4 is a v-shaped wedge design necktie trim apparel article designed to conform and attach to the apex of a necktie 24 through a crimping process.

In accordance with the invention, the Tie Tip as shown consists of a stamped metal front side 12 conforming to the apex of a necktie and from which side sections 16R and 16L are bent out and further bent back-over to form a back side 18 and back top sides 14L and 14R spaced from the front side 12 and adapted to receive the apex of a necktie 24 through the occurring opening 10. The Tie Tip design allows for a wider Top 20 then bottom 22, obviously necessary to conform to the apex of a necktie. Once the apex of a necktie 24 is inserted into the Tie Tip opening 10, the back top sides 14L and 14R are crimped against the front side 12. The resulting appearance is shown in FIG. 1 and FIG. 2.

In the described embodiment (FIGS. 1 to 4) the Tie Tip will be constructed of durable material, flexible enough to allow crimping, yet is securely fastened. It should be stated that the V-shaped wedge design as illustrated in FIGS. 1 to 4 is the preferred embodiment. However, other similar type v-shaped wedge designs are possible design options. In addition, the Tie Tip can be constructed of any material(s) and color(s).

Operation—FIGS. 1 to 4

For the described and illustrated Tie Tip (FIGS. 1 to 4), the apex of a necktie 24 is inserted into the top of the Tie Tip 20 through the Tie Tip opening 10 until the apex of the necktie 24 touches the bottom of the Tie Tip 22 and sides 16L and 16R. The front side of the Tie Tip 12 will be outwardly visible when placed on the necktie. The back side of the Tie Tip 18 will not be outwardly visible when placed on the necktie. Once the Tie Tip is placed on the necktie, the back top sides 14R and 14L are crimped against the necktie to securely fasten it. Attachment occurs by force applied to the necktie material against the front and back of the Tie Tip, thus, not damaging the necktie material as occurs with other such trim articles and attachment processes.

Summary, Ramifications, and Scope

Accordingly, the reader will see that the Tie Tip is a v-shaped wedge design trim article designed to conform and attach to the apex of a necktie through a crimping process. No supplemental attachment process is required. Damage to the necktie material will not occur. Manufacturing costs will be relatively inexpensive. The above descriptions and illustrations describe just one (1) embodiment and ramification of the Tie Tip. While many embodiments and ramifications are available for the Tie Tip, all have the advantages in that it provides protection to the apex of a necktie (that area covered by the Tie Tip) against stains (foods, liquids, etc.);

it provides protection against fraying and wearing of the apex of a necktie;

it provides a durable and lightweight attachment to the apex of a necktie, which will allow a necktie to hang straight and eliminate wrinkles;

it provides an attachment to the apex of a necktie that can be produced in a variety of sizes, designs, materials, and colors;

it provides an attachment to the apex of a necktie that can either be permanently attached or be removable.

Although the description above contains many specifications, these should not be construed as limiting the scope of the invention, but to merely provide illustrations of some of the presently preferred embodiments and ramifications of this invention. Thus the scope of the invention should be determined by the appended claim and its legal equivalents, rather then by the examples given.

I claim:

1. A v-shaped hollow wedge trim article designed to conform and attach to an apex of a necktie through a crimping process, the interior surfaces of said wedge being smooth; said trim article consisting of a v-shaped wedge enclosure comprising a v-shaped wedge front plate conforming to the apex of necktie and back plate sections and side walls, said back plate sections arranged spaced from said front plate by said side walls, said front plate and said back plate sections and said side walls being formed from stamped material bent up and over to form said side walls and said back plate sections to provide an opening therebetween for accepting said apex of necktie, said front plate and said back plate sections being firmly pinched together with said apex of necktie inserted between, thereby applying force to said apex of necktie as said front and said back plate sections of said trim article are drawn together to securely fasten said trim article to said apex of necktie.

* * * * *